US011546981B1

(12) United States Patent
Peng

(10) Patent No.: US 11,546,981 B1
(45) Date of Patent: Jan. 3, 2023

(54) LED LIGHT STRING WITH AUTOMATIC SEQUENCING FUNCTION AND METHOD OF AUTOMATICALLY SEQUENCING THE SAME

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 15 days.

(21) Appl. No.: 17/411,402

(22) Filed: Aug. 25, 2021

(51) Int. Cl.
*H05B 45/44* (2020.01)
*H05B 47/165* (2020.01)

(52) U.S. Cl.
CPC ..... *H05B 45/44* (2020.01); *H05B 47/165* (2020.01)

(58) Field of Classification Search
CPC ..... H05B 45/44; H05B 47/165
See application file for complete search history.

(56) References Cited

U.S. PATENT DOCUMENTS

2010/0308738 A1* 12/2010 Shteynberg ..... H05B 45/44 315/185 R
2021/0212179 A1* 7/2021 Zhao ..... H05B 45/44

FOREIGN PATENT DOCUMENTS

CN 112822816 A 5/2021
TW 201613417 A 4/2016
WO WO-2014/117294 A1 8/2014

* cited by examiner

*Primary Examiner* — Daniel D Chang
(74) *Attorney, Agent, or Firm* — Muncy, Geissler, Olds & Lowe, P.C.

(57) ABSTRACT

A method of automatically sequencing an LED light string. The LED light string includes a plurality of LED modules. The method includes steps of: (a) building a start reference time before the LED modules start to operate, (b) generating a plurality of time difference values from the start reference time when a working voltage of each of the LED modules rises to an identification voltage after the LED modules operate, (c) determining the sequence of the LED modules according to the time difference values to achieve an automatic sequencing function.

14 Claims, 8 Drawing Sheets

LED LIGHT STRING WITH AUTOMATIC SEQUENCING FUNCTION AND METHOD OF AUTOMATICALLY SEQUENCING THE SAME

BACKGROUND

Technical Field

The present disclosure relates to an LED light string with automatic sequencing function and a method of automatically sequencing the same, and more particularly to an LED light string with automatic sequencing function and a method of automatically sequencing the same by calculating time difference values.

Description of Related Art

The statements in this section merely provide background information related to the present disclosure and do not necessarily constitute prior art.

Since light-emitting diode (LED) has the advantages of high luminous efficiency, low power consumption, long life span, fast response, high reliability, etc., LEDs have been widely used in lighting fixtures or decorative lighting, such as Christmas tree lighting, lighting effects of sport shoes, etc. by connecting light bars or light strings in series, parallel, or series-parallel.

Take the festive light for example. Basically, a complete LED lamp includes an LED light string having a plurality of LEDs and a drive unit for driving the LEDs. The drive unit is electrically connected to the LED light string, and controls the LEDs by a pixel control manner or a synchronous manner by providing the required power and the control signal having light data to the LEDs, thereby implementing various lighting output effects and changes of the LED lamp.

According to the present technology, in order to drive the LEDs of the LED light string to diversify light emission, the LEDs have different address sequence data. The LEDs receive light signals including light data and address data. If the address sequence data of the LEDs are the same as the address data of the light signals, the LEDs emit light according to the light data of the light signals. If the address sequence data of the LEDs are not the same as the address data of the light signals, the LEDs ignore the light data of the light signals.

At present, most of the LED sequence methods of the LED light string are complicated and/or difficult. For example, before the LEDs are combined into an LED light string, it is necessary to burn different address sequence data for each LED. Afterward, the LEDs are sequentially arranged and combined into the LED light string according to the address sequence data. If the LEDs are not arranged in sequence according to the address sequence data, the diversified light emission of the LEDs cannot be correctly achieved.

SUMMARY

An object of the present disclosure is to provide an LED light string with automatic sequencing function to solve the problem of the prior art using address to sequence LEDs of an LED light string.

In order to achieve the above-mentioned object, the LED light string with automatic sequencing function includes a circuit switch, a plurality of LED modules, and a control unit. The LED modules are electrically connected to the circuit switch. Each LED module includes an identification circuit. The identification circuit is connected to a drive voltage source. The control unit generates a control signal to turn on and turn off the circuit switch. Before the LED modules start to operate, the control unit turns off the circuit switch so that a working voltage of each LED module is less than an identification voltage and the identification circuit builds a start reference time. The control unit turns on the circuit switch so that the working voltage increases to the identification voltage and the identification circuit generates a plurality of time difference values from the start reference time. The LED modules determine the sequence of the LED modules according to the time difference values to achieve an automatic sequencing function.

In one embodiment, the time difference values are compared with a plurality of time difference ranges to determine the sequence of the LED modules.

In one embodiment, the time difference ranges are built in a lookup table.

In one embodiment, the identification circuit includes a plurality of diodes, a switch, a resistor, and a switching switch. The diodes are connected in series. The switch is connected to the diodes in series to form a series-connected path. A first end of the resistor is connected to a first end of the series-connected path. The switching switch is connected to a second end of the series-connected path and a second end of the resistor, and switches the operation of the dioses and the switch of the series-connected path, or the operation of the resistor.

In one embodiment, the identification circuit includes a plurality of p-type MOSFET switches, a p-type MOSFET switch, and a switching switch. The p-type MOSFET switches are connected in series to form a series-connected path. A first end of the p-type MOSFET switch is connected to a first end of the series-connected path. The switching switch is connected to a second end of the series-connected path and a second end of the p-type MOSFET switch, and switches the operation of the p-type MOSFET switches of the series-connected path, or the operation of the p-type MOSFET switch.

In one embodiment, the identification circuit includes a plurality of n-type MOSFET switches, a n-type MOSFET switch, and a switching switch. The n-type MOSFET switches are connected in series to form a series-connected path. A first end of the n-type MOSFET switch is connected to a first end of the series-connected path. The switching switch is connected to a second end of the series-connected path and a second end of the n-type MOSFET switch, and switches the operation of the n-type MOSFET switches of the series-connected path, or the operation of the n-type MOSFET switch.

In one embodiment, the LED modules are connected in series to form the LED light string.

In one embodiment, the LED modules are connected in series and in parallel to form the LED light string.

In one embodiment, the LED modules are connected in parallel and in series to form the LED light string.

Accordingly, the LED light string with automatic sequencing function is provided to determine the sequence of the LED modules by using the built-in lookup table to acquire the relationship between the time difference values and the sequence of the LED modules, thereby simplifying the circuit design and quickly complete the sequence of the LED light string.

Another object of the present disclosure is to provide a method of automatically sequencing an LED light string to solve the problem of the prior art using address to sequence LEDs of an LED light string.

In order to achieve the above-mentioned object, the LED light string includes a plurality of LED modules. The method includes steps of: (a) building a start reference time before the LED modules start to operate, (b) generating a plurality of time difference values from the start reference time when a working voltage of each of the LED modules rises to an identification voltage after the LED modules operate, (c) determining the sequence of the LED modules according to the time difference values to achieve an automatic sequencing function.

In one embodiment, the step (a) further includes a step of: turning off a circuit switch electrically connected to the LED modules so that the working voltage of each of the LED modules is less than the identification voltage to building the start reference time.

In one embodiment, the step (b) further includes a step of: turning on the circuit switch so that the working voltage rises to the identification voltage.

In one embodiment, the time difference values are compared with a plurality of time difference ranges to determine the sequence of the LED modules.

In one embodiment, the time difference ranges are built in a lookup table.

Accordingly, the method of automatically sequencing an LED light string is provided to determine the sequence of the LED modules by using the built-in lookup table to acquire the relationship between the time difference values and the sequence of the LED modules, thereby simplifying the circuit design and quickly complete the sequence of the LED light string.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1:
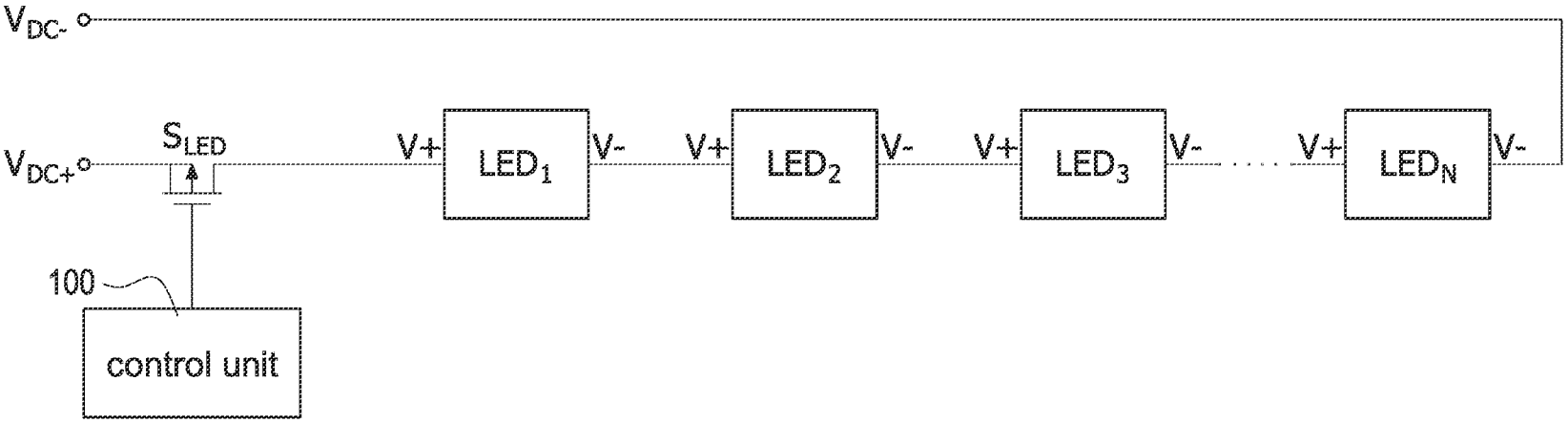
FIG. 1 is a block circuit diagram of an LED light string with automatic sequencing function composed of a plurality of LED modules connected in series according to the present disclosure.

Reference will now be made to the drawing figures to describe the present disclosure in detail. It will be understood that the drawing figures and exemplified embodiments of present disclosure are not limited to the details thereof.

Please refer to FIG. 1, which shows a block circuit diagram of an LED light string with automatic sequencing function composed of a plurality of LED modules connected in series according to the present disclosure. In this embodiment, the LED light string with automatic sequencing function (hereinafter referred to as the LED light string) includes a plurality of LED modules $LED_1$~$LED_N$. The LED modules $LED_1$~$LED_N$ form a series-connected LED light string. A positive voltage end V+ of the first LED module $LED_1$ is coupled to a DC positive voltage end $V_{DC+}$ through a switch SLED. The LED modules in the middle are connected in series. A negative voltage end V− of the last LED module $LED_N$ is coupled to a DC negative voltage end $V_{DC}$−. Under this circuit structure, a control unit 100 is used to turn on and turn off the switch SLED, and then to control whether the DC driving voltage $V_{DD}$ supplies power and drives the LED modules $LED_1$~$LED_N$.

Figure 2:
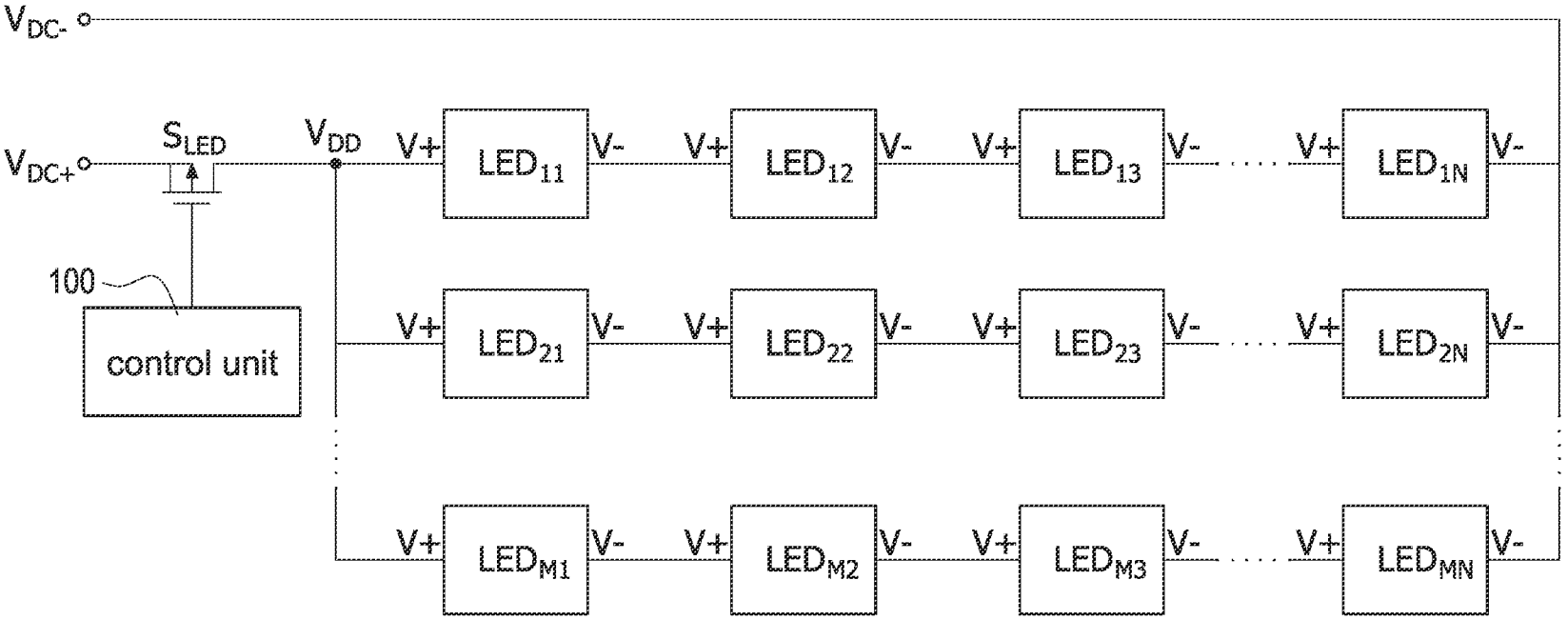
FIG. 2 is a block circuit diagram of the LED light string with automatic sequencing function composed of the plurality of LED modules connected in series and in parallel according to the present disclosure.

Please refer to FIG. 2, which shows a block circuit diagram of the LED light string with automatic sequencing function composed of the plurality of LED modules connected in series and in parallel according to the present disclosure. In this embodiment, the LED light string includes a plurality of LED modules $LED_{11}$-$LED_1N$, $LED_{21}$-$LED_{2N}$, $LED_{M1}$-$LED_{MN}$. The LED modules form a series-connected structure of N LED modules, and the LED light string is formed by connecting M series-connected structures in parallel. A positive voltage end V+ of the first LED module $LED_{11}$, $LED_{21}$, $LED_{M1}$ of the series-connected structures is coupled to a DC positive voltage end $V_{DC+}$ through to a switch SLED. The LED modules in the middle are connected in series and/or in parallel. A negative voltage end V− of the last LED module $LED_{1N}$, $LED_2N$, $LED_{MN}$ is coupled to a DC negative voltage end $V_{DC-}$. Under this circuit structure, the control unit 100 is used to turn on and turn off the switch SLED, and then to control whether the DC driving voltage $V_{DD}$ supplies power and drives the LED modules $LED_{11}$-$LED_{1N}$, $LED_{21}$-$LED_{2N}$, $LED_{M1}$-$LED_{MN}$.

Figure 3:
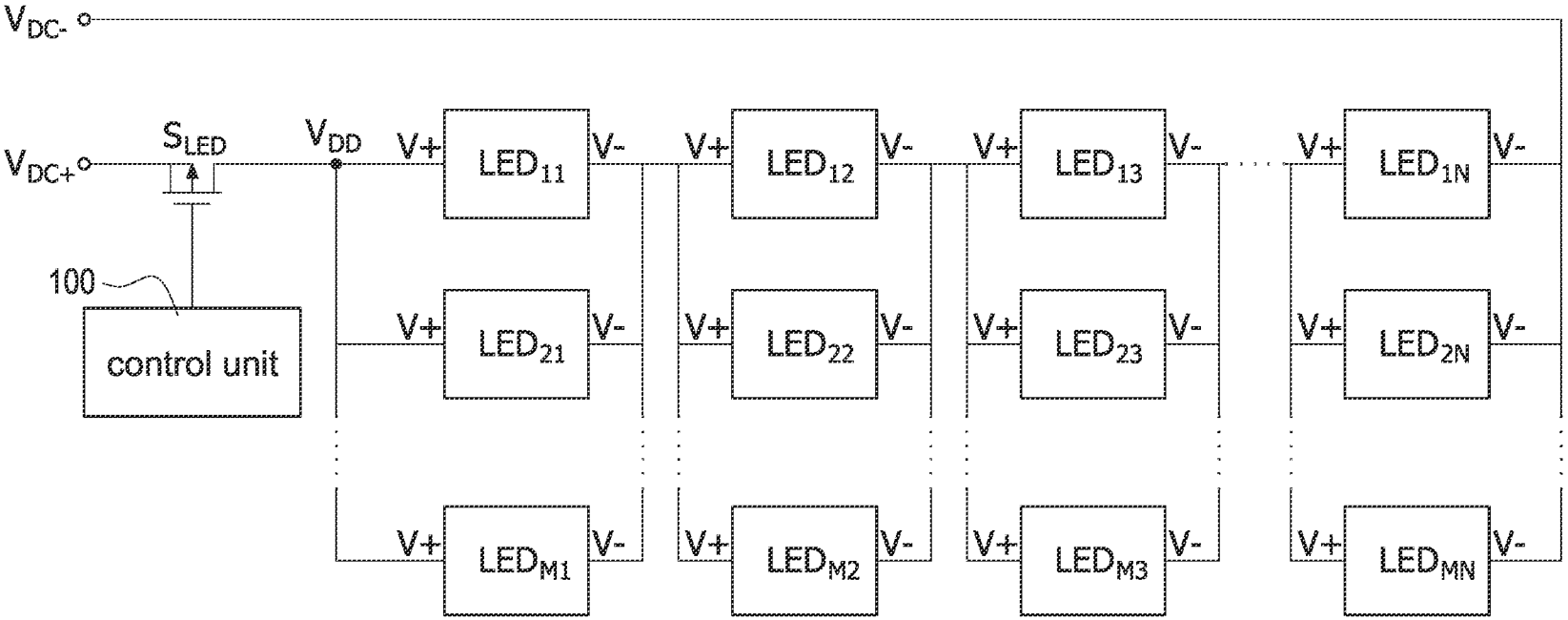
FIG. 3 is a block circuit diagram of the LED light string with automatic sequencing function composed of the plurality of LED modules connected in parallel and in series according to the present disclosure.

Please refer to FIG. 3, which shows a block circuit diagram of the LED light string with automatic sequencing function composed of the plurality of LED modules connected in parallel and in series according to the present disclosure. In this embodiment, the LED light string includes a plurality of LED modules $LED_{11}$-$LED_{M1}$, $LED_{12}$-$LED_{M2}$, $LED_{1N}$-$LED_{MN}$. The LED modules form a parallel-connected structure of M LED modules, and the LED light string is formed by connecting N parallel-connected structures in series. A positive voltage end V+ of the first LED module $LED_{11}$, $LED_{21}$, $LED_{M1}$ of the parallel-connected structures is coupled to a DC positive voltage end $V_{DC+}$ through to a switch SLED. The LED modules in the middle are connected in series and/or in parallel. A negative voltage end V− of the last LED module $LED_{1N}$, $LED_{2N}$, $LED_{MN}$ is coupled to a DC negative voltage end $V_{DC-}$. Under this circuit structure, the control unit 100 is used to turn on and turn off the switch SLED, and then to control whether the DC driving voltage $V_{DD}$ supplies power and drives the LED modules $LED_{11}$-$LED_{M1}$, $LED_{12}$-$LED_{M2}$, $LED_{1N}$-$LED_{MN}$.

Figure 4A:
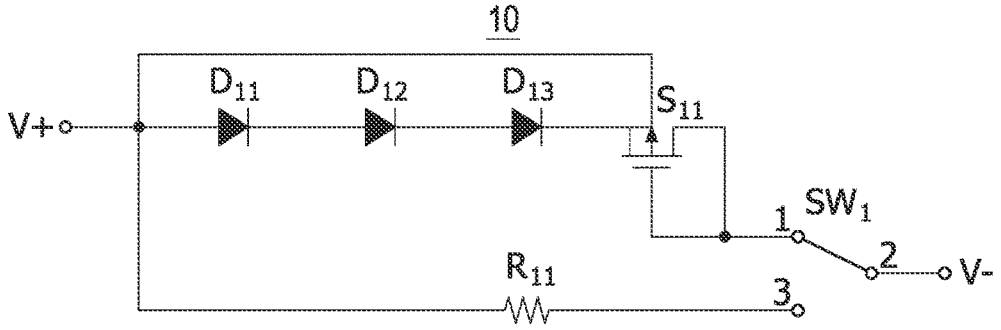
FIG. 4A is a circuit diagram of an identification circuit of the LED module according to a first embodiment of the present disclosure.

Take the series-connected LED light string shown in FIG. 1 as an example, and it is assumed that the number of LED modules is 50. Each LED modules includes an identification circuit 10. Please refer to FIG. 4A, which shows a circuit diagram of an identification circuit of the LED module according to a first embodiment of the present disclosure. In this embodiment, the identification circuit 10 includes, for example, but not limited to, three diodes $D_{11}$-$D_{13}$ connected in series and a switch $S_{11}$ connected to the series-connected diodes $D_{11}$-$D_{13}$. For example, the forward bias voltage of the three series-connected diodes $D_{11}$-$D_{13}$ is 2.1 volts (each is 0.7 volts), plus the 0.7-volt forward bias voltage of the switch $S_{11}$ is a total forward bias voltage of 2.8 volts. When the external DC driving voltage $V_{DD}$ gradually increases and has not yet reached but is close to 2.8 volts (for example, but not limited to 2.6 volts), the switch SLED is turned off so that the DC driving voltage $V_{DD}$ instantaneously decreases and is less than an identification voltage $V_{IDEN}$. At this condition, the switching switch SW is switched from the connection between a second end and a first end to the connection between the second end and a third end, that is, from a path composed of the series-connected diodes $D_{11}$-$D_{13}$ and the switch $S_{11}$ to a path composed of the resistor $R_{11}$. At this time, the time is recorded as the start reference time $t_0$, and the start reference time $t_0$ is used as a reference time of calculating time difference values. When the voltages of the plurality of LED modules gradually increase to reach the identification voltage $V_{IDEN}$, the plurality of time difference values of the LED modules can be acquired. Take the first LED module as an example, a first time difference is $T_1=t_1-t_0$.

Figure 5:
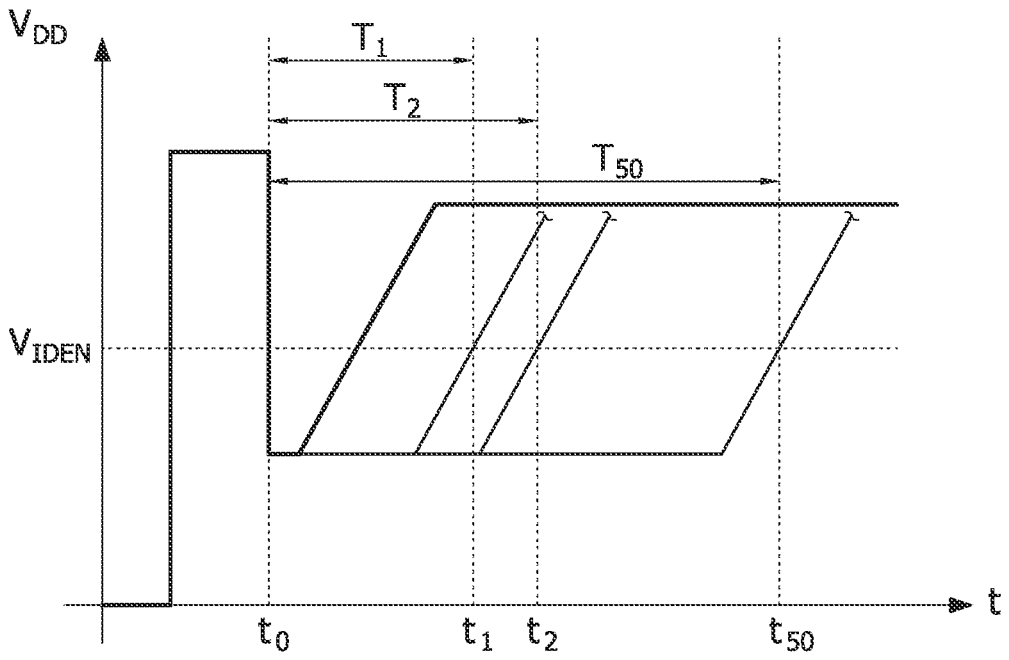
FIG. 5 is a schematic waveform diagram of automatically sequencing the LED modules by calculating time difference values according to the present disclosure.

At this condition, the voltage waveforms of the positive voltage ends V+ of all 50 LED modules relative to the negative voltage ends V− (hereinafter referred to as the relative voltage waveforms) are as shown in FIG. 5. According to the circuit characteristics as shown in FIG. 5, that is, for different LED modules, the 50 sets of relative voltage waveforms have an obvious positive correlation with their series-connected sequence. Therefore, according to this circuit characteristic, the automatic sequence of all 50 LED modules can be achieved through the calculation of time difference values.

Specifically, since the relative voltage waveforms are the voltage characteristics of individual LED modules, all (50 sets) of relative voltage waveforms may be used to effectively determine the sequence of the corresponding LED modules, the concept of start reference (base) time is introduced. That is, by calculating the time difference between the time of each relative voltage waveform and the start reference time, a plurality of different time difference values can be acquired. As shown in FIG. 5, since the DC driving voltage $V_{DD}$ gradually increases and the voltage of the first LED module $LED_1$ reaches the identification voltage $V_{IDEN}$, a time difference value from the start reference time $t_0$ to the time when the voltage of the first LED module $LED_1$ reaches the identification voltage $V_{IDEN}$ is the first time difference value $T_1$. Similarly, since the DC driving voltage $V_{DD}$ gradually increases and the voltage of the second LED module $LED_2$ reaches the identification voltage $V_{IDEN}$, a time difference value from the start reference time $t_0$ to the time when the voltage of the second LED module $LED_2$ reaches the identification voltage $V_{IDEN}$ is the second time difference value $T_2$. The rest may be deduced by analogy, since the DC driving voltage $V_{DD}$ gradually increases and the voltage of the $50^{th}$ LED module $LED_{50}$ reaches the identification voltage $V_{IDEN}$, a time difference value from the start reference time $t_0$ to the time when the voltage of the $50^{th}$ LED module $LED_{50}$ reaches the identification voltage $V_{IDEN}$ is the $50^{th}$ time difference value $T_{50}$.

Before the start reference time $t_0$, since the switch SLED is turned on, the DC driving voltage $V_{DD}$ instantaneously increases, and all LED modules become a high potential state. At the start reference time $t_0$, the switch SLED is turned off, and the DC driving voltage $V_{DD}$ instantaneously decreases. As shown in FIG. 5, when the DC driving voltage $V_{DD}$ instantaneously decreases and is less than the identification voltage $V_{IDEN}$, the time at that instant is set (defined) as the start reference time $t_0$.

Figure 4B:
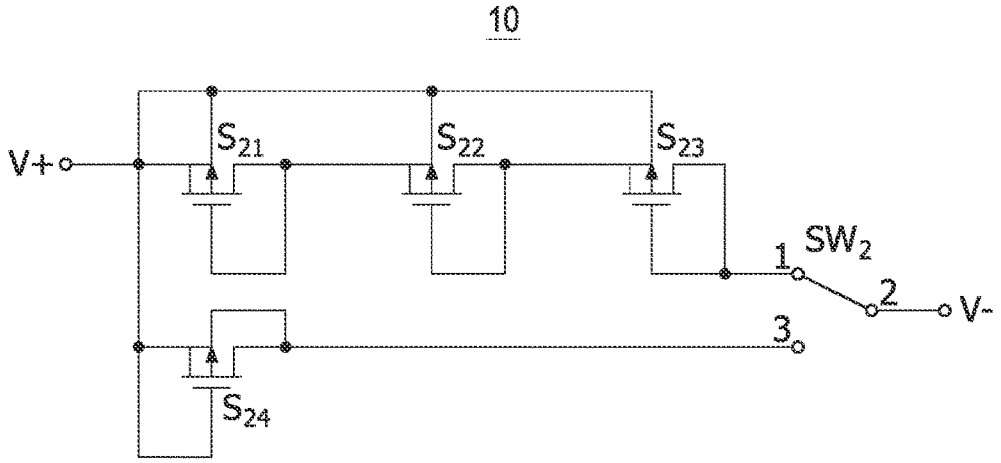
FIG. 4B is a circuit diagram of the identification circuit of the LED module according to a second embodiment of the present disclosure.

Please refer to FIG. 4B, which shows a circuit diagram of the identification circuit of the LED module according to a second embodiment of the present disclosure. Since substrates of the p-type MOSFET switches $S_{21}$, $S_{22}$, $S_{23}$ are connected together as a common reference point (i.e., the substrate is directly used), and the circuit characteristic is similar to the extremely small resistance value, currents flowing through the switches $S_{21}$, $S_{22}$, $S_{23}$ are very large (for example, 350 mA), and the similar circuit effect is for each LED module. Based on the principle of high current instantaneous discharge, therefore, the relative voltage waveforms of the LED modules may be regarded as overlapping on the same line at the start reference time $t_0$.

In other words, the switch SLED is first turned on, and the DC driving voltage $V_{DD}$ instantaneously increases. Afterward, the switch SLED is turned off so that the DC driving voltage $V_{DD}$ instantaneously decreases and the relative voltage waveforms of the LED modules may overlap on the same line at the start reference time $t_0$. Therefore, the start reference time $t_0$ is used as the reference time of calculating time difference values. At this condition, the switching switch SW is switched from the connection between a second end and a first end to the connection between the second end and a third end, that is, from a path composed of the series-connected switches $S_{21}$-$S_{23}$ to a path composed of a switch $S_{24}$. At this time, the time is recorded as the start reference time $t_0$, and the start reference time $t_0$ is used as a reference time of calculating time difference values. Afterward, the switch SLED is turned on and the DC driving voltage $V_{DD}$ slowly increases by for example, but not limited to, connecting to a capacitor component, and therefore the voltage of the LED module gradually increases. When the voltages of the plurality of LED modules gradually increase to reach the identification voltage $V_{IDEN}$, the plurality of time difference values of the LED modules can be acquired. Take the first LED module as an example, a first time difference is $T_1=t_1-t_0$. Therefore, the complete 50 sets of relative voltage waveforms can be shown in FIG. 5.

Figure 4C:
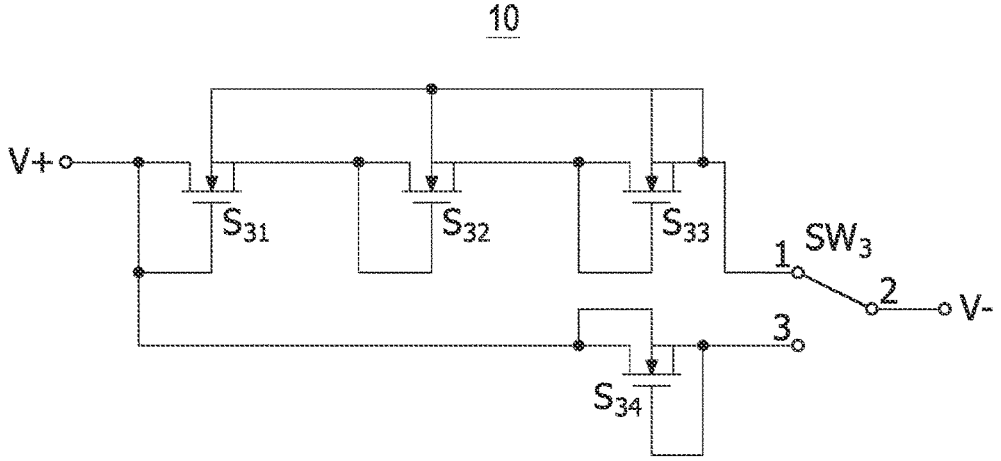
FIG. 4C is a circuit diagram of the identification circuit of the LED module according to a third embodiment of the present disclosure.

Please refer to FIG. 4C, which shows a circuit diagram of the identification circuit of the LED module according to a third embodiment of the present disclosure. The major difference between the third embodiment and the second embodiment is that the n-type MOSFET switches $S_{31}$, $S_{32}$, $S_{33}$ are used, and substrates of the n-type MOSFET switches $S_{31}$, $S_{32}$, $S_{33}$ are connected together as a common reference point. The rest of the operation principles may be similar to the identification circuit of the second embodiment, and the detail description is omitted here for conciseness.

Accordingly, the start reference time $t_0$ can be defined and recorded, and time difference values $T_1$-$T_{50}$ of the corresponding LED modules $LED_1$-$LED_{50}$ can be acquired based on the start reference time $t_0$.

In one embodiment, the identification voltage $V_{IDEN}$ is, for example, but not limited to, 1.5 volts or 2 volts. In addition, the voltage (before it instantaneously decreased) at the start reference time $t_0$ is, for example, but not limited to, 3 volts, since an external supply voltage of 150 volts are averagely shared by 50 LED modules.

Furthermore, by building a lookup table in each of the LED modules $LED_1$-$LED_N$, the identification and determination of sequencing the LED modules $LED_1$-$LED_N$ can be implemented. For example, the circuit designer may build the lookup table in advance according to the sequence of the LED modules $LED_1$-$LED_N$ according to the size (range) of the time difference values (ranges).

As the following table, an implement of the lookup table is exemplified. Take 50 LED modules $LED_1$-$LED_N$ as an example to illustrate.

| sequence | time difference values/ranges (μs) |
|---|---|
| #1 | 6-8 |
| #2 | 8-10 |
| #3 | 10-12 |
| #4 | 12-14 |
| #5 | 14-16 |
| #6 | 16-18 |
| . . . | . . . |
| #50 | 104-106 |

Therefore, after each LED module $LED_1$-$LED_N$ operates, all LED modules $LED_1$-$LED_N$ can be sequenced according to the acquired time difference values corresponding to the sequence in the built-in lookup table. For example, when the time difference value of 12.95 μs of the LED module is acquired, the LED module is determined to be the fourth LED module according to the built-in lookup table. Similarly, when the time difference value of 17.08 μs of the LED module is acquired, the LED module is determined to be the sixth LED module according to the built-in lookup table. The rest may be deduced by analogy. Therefore, the sequence of the LED modules can be determined according to the time difference values to achieve an automatic sequencing function.

Incidentally, the above-mentioned time difference values in the lookup table are designed based on the time range, that is, it is not compared with a specific time value. As the example disclosed above, the design of sequence correspondence is, for example, but not limited to, in a time range of 2 microseconds (μs). In fact, the time range in the lookup table may be designed differently according to the number of LED modules, the magnitude of the identification voltage $V_{IDEN}$, or other circuit parameters.

Accordingly, when the sequence of the LED light string having the LED modules is completed, the sequence mode is finished, and the operation of the identification circuit 10 is no longer required, and the normal operation mode is performed. That is, the sequence data and the lighting data are transmitted to perform the lighting behavior of the LED modules.

Figure 6A:
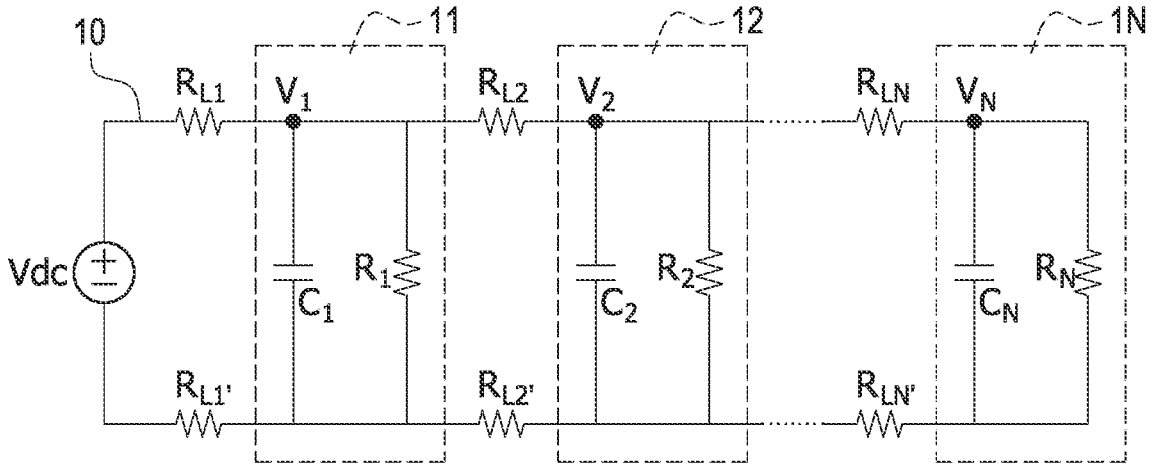
FIG. 6A is a circuit diagram of a parallel sequenced LED light string supplied power by a constant-voltage source according to a first embodiment of the present disclosure.
Figure 6B:
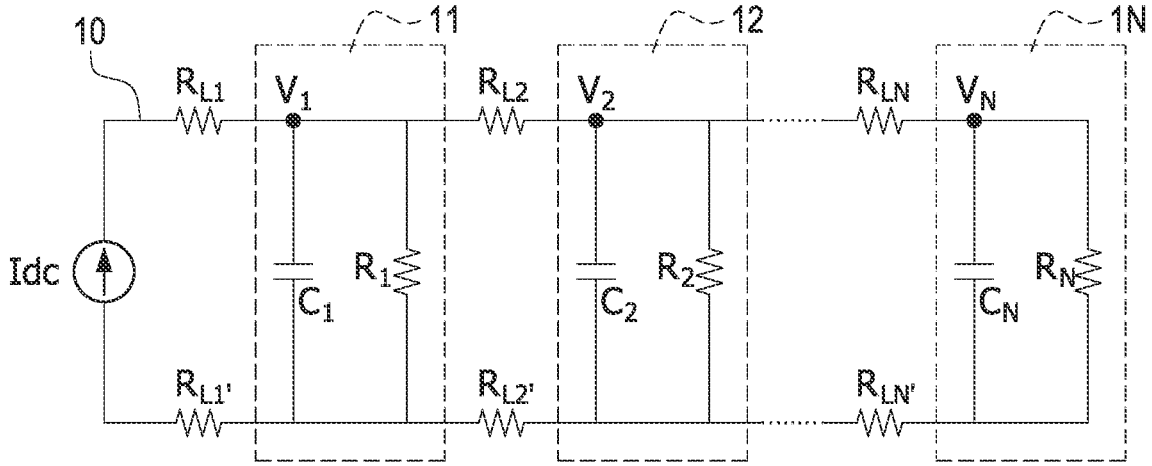
FIG. 6B is a circuit diagram of the parallel sequenced LED light string supplied power by a constant-current source according to the first embodiment of the present disclosure.

Please refer to FIG. 6A and FIG. 6B, which show circuit diagrams of a parallel sequenced LED light string supplied power by a constant-voltage source and a constant-current source according to a first embodiment of the present disclosure, respectively. Furthermore, please refer to FIG. 7A and FIG. 7B, which show circuit diagrams of a parallel sequenced LED light string supplied power by the constant-voltage source and the constant-current source according to a second embodiment of the present disclosure, respectively. As mentioned above, the manner of sequencing the LED light string composed of series-connected LED modules $LED_1$-$LED_N$ is the time difference values (ranges) built in the lookup table. In addition, the manner of sequencing the LED light string composed of parallel-connected LED modules is the resistance adjustment or resistance compensation. Therefore, for the LED modules connected in series and in parallel (shown in FIG. 2) or the LED modules connected in parallel and in series (shown in FIG. 3), the series-connected structure is implemented according to FIG. 4A to FIG. 4C and FIG. 5, and the parallel-connected structure is implemented according to FIG. 6A and FIG. 6B, and FIG. 7A and FIG. 7B, described as follows.

As shown in FIG. 6A, the parallel-connected LED modules 11, 12, . . . , 1N receive a supply power Vdc. In this embodiment, the supply power Vdc is a constant-voltage source for providing a voltage source with a constant voltage value. The LED modules 11, 12, . . . , 1N respectively get different voltages through the wire resistances $R_{L1}$, $R_{L2}$, . . . , $R_{LN}$, $R_{L1'}$, $R_{L2'}$, . . . , $R_{LN'}$ and the resistances $R_1$, $R_2$, . . . , $R_N$ of the LED modules 11, 12, . . . , 1N from the supply power Vdc.

At the time of power-on, since the circuits in each of the LED modules 11, 12, . . . , 1N have not been started or operated, each of the LED modules 11, 12, . . . , 1N may be equivalent to the corresponding resistances $R_1$, $R_2$, . . . , $R_N$. For the convenience of description, the wire resistance $R_{L1}$ and the wire resistance $R_{L1'}$ may be equivalent to the single-wire wire resistance $R_{L1}$. Similarly, the wire resistance $R_{L2}$ and the wire resistance $R_{L2'}$ may be equivalent to the single-wire wire resistance $R_{L2}$, . . . , and the wire resistance $R_{LN}$ and the wire resistance $R_{LN'}$ may be equivalent to the single-wire wire resistance $R_{LN}$.

After the time of power-on, the supply power Vdc supplies power to the LED modules 11, 12, . . . , 1N. Due to the voltage difference caused by the current flowing through the wire resistances $R_{L1}$, $R_{L2}$, . . . , $R_{LN}$, the voltages generated on the LED modules 11, 12, . . . , 1N are different. In this embodiment, the voltage difference caused by the power supply Vdc of the constant-voltage source through the wire resistances $R_{L1}$, $R_{L2}$, . . . , $R_{LN}$ is the voltage drop. Please refer to FIG. 6A, which shows a schematic voltage diagram of the parallel sequenced LED light string according to the first embodiment of the present disclosure. A first voltage $V_1$ on the first LED module 11 is greater than a second voltage $V_2$ on the second LED module 12, the second voltage $V_2$ is greater than a third voltage $V_3$ on the third LED module 13, and the rest may be deduced by analogy. The voltage generated by the front (up-stream) LED module is greater than the voltage generated by the rear (down-stream) LED module, i.e., $V_1 > V_2 > \ldots > V_N$. Accordingly, the LED modules 11, 12, . . . , 1N are sequenced according to the different generated voltages $V_1$, $V_2$, . . . , $V_N$. In the following, the different generated voltages $V_1, V_2, \ldots, V_N$ and the sequence principle of the LED modules 11, 12, . . . , 1N are described.

In one embodiment, it can be implemented by means of a built-in corresponding look-up table. For example, the circuit designer may build the look-up table in advance according to the power supply Vdc, the number of the LED modules 11, 12, . . . , 1N, the (estimated) wire resistances $R_{L1}, R_{L2}, \ldots, R_{LN}$, and the resistances $R_1, R_2, \ldots, R_N$ for the different generated voltages $V_1, V_2, \ldots, V_N$, thereby sequencing the LED modules 11, 12, . . . , 1N.

In order to increase the accuracy of comparison, determination, and identification between the detected voltage and the voltage ranges of the look-up table, each of the resistances $R_1, R_2, \ldots, R_N$ in each of the LED modules 11, 12, . . . , 1N is a controllable resistor with an adjustable resistance. When the LED modules 11, 12, . . . , 1N are sequenced at the time of power-on, the resistance value of each of the controllable resistors (that is, the resistances $R_1, R_2, \ldots, R_N$) may be designed to be the minimum value so that the current flowing through each of the resistances $R_1, R_2, \ldots, R_N$ is maximized. Therefore, the voltages $V_1, V_2, \ldots, V_N$ generated on each of the LED modules 11, 12, . . . , 1N can be maximized, thereby increasing the accuracy of comparison, determination, and identification between the detected voltage and the voltage ranges of the look-up table.

As shown in FIG. 6B, in this embodiment, the supply power Idc is a constant-current source for providing a current source with a constant current value. The LED modules 11, 12, . . . , 1N respectively get different voltages through the wire resistances $R_{L1}, R_{L2}, \ldots, R_{LN}, R_{L1'}, R_{L2'}, \ldots, R_{LN'}$ and the resistances $R_1, R_2, \ldots, R_N$ of the LED modules 11, 12, . . . , 1N from the supply power Idc.

At the time of power-on, since the circuits in each of the LED modules 11, 12, . . . , 1N have not been started or operated, each of the LED modules 11, 12, . . . , 1N may be equivalent to the corresponding resistances $R_1, R_2, \ldots, R_N$. For the convenience of description, the wire resistance $R_{L1}$ and the wire resistance $R_{L1'}$ may be equivalent to the single-wire wire resistance $R_{L1}$. Similarly, the wire resistance $R_{L2}$ and the wire resistance $R_{L2'}$ may be equivalent to the single-wire wire resistance $R_{L2}$, . . . , and the wire resistance $R_{LN}$ and the wire resistance $R_{LN'}$ may be equivalent to the single-wire wire resistance $R_{LN}$.

After the time of power-on, the supply power Idc supplies power to the LED modules 11, 12, . . . , 1N. Due to the voltage difference caused by the current flowing through the wire resistances $R_{L1}, R_{L2}, \ldots, R_{LN}$, the voltages generated on the LED modules 11, 12, . . . , 1N are different. In this embodiment, the voltage difference caused by the power supply Idc of the constant-current source through the wire resistances $R_{L1}, R_{L2}, \ldots, R_{LN}$ is the voltage rise.

Please refer to FIG. 3B, which shows a schematic voltage diagram of the parallel sequenced LED light string according to the second embodiment of the present disclosure. A first voltage $V_1$ on the first LED module 11 is less than a second voltage $V_2$ on the second LED module 12, the second voltage $V_2$ is less than a third voltage $V_3$ on the third LED module 13, and the rest may be deduced by analogy. The voltage generated by the front (up-stream) LED module is less than the voltage generated by the rear (down-stream) LED module, i.e., $V_1<V_2<\ldots<V_N$. Accordingly, the LED modules 11, 12, . . . , 1N are sequenced according to the different generated voltages $V_1, V_2, \ldots, V_N$. In the following, the different generated voltages $V_1, V_2, \ldots, V_N$ and the sequence principle of the LED modules 11, 12, . . . , 1N are described.

Figure 7A:
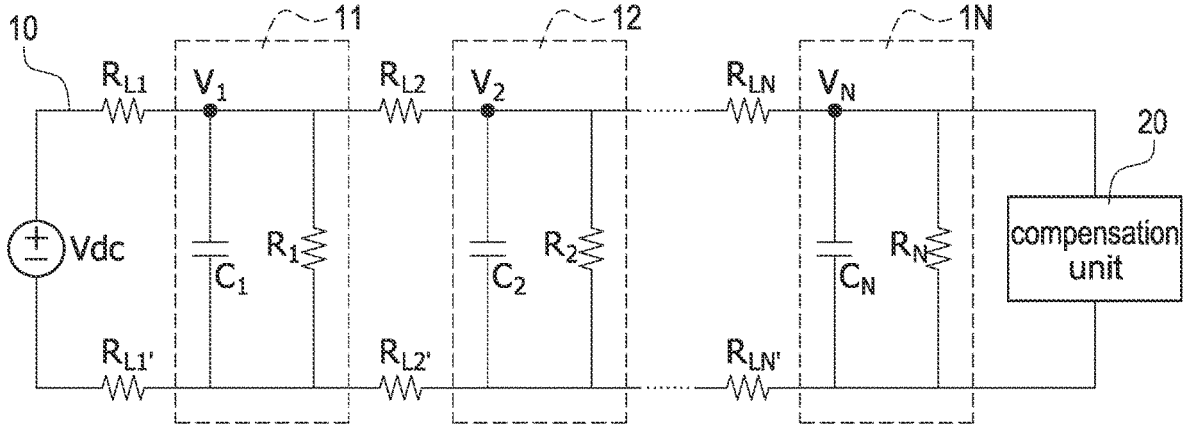
FIG. 7A is a circuit diagram of a parallel sequenced LED light string supplied power by the constant-voltage source according to a second embodiment of the present disclosure.

The major difference between the LED light string shown in FIG. 7A and the LED light string shown in FIG. 6A is that the resistance value of each LED module 11, 12, . . . , 1N in the LED light string of FIG. 2A does not have the controllable characteristics as shown in FIG. 1A. Therefore, in order to achieve the effect of resistance compensation, the LED light string shown in FIG. 2A further includes a compensation unit 20 to replace the controllable adjustment of the resistance in each LED module 11, 12, . . . , 1N as shown in FIG. 1A. In other words, the compensation manner with adjustable resistance (that is, the resistance is controllable) shown in FIG. 1A and FIG. 1B will be implemented by the compensation unit 20. Therefore, not only simplify the circuit control, but also save the circuit costs. In particular, the compensation unit 20 is an integrated circuit (IC), which has a counting function, or the compensation unit 20 is a circuit self-designed by an analog circuit and a digital circuit, which has a counting function.

Therefore, when the power is turned on for the first time, since the resistances $R_1, R_2, \ldots, R_N$ are connected in parallel, the equivalent resistance value is the smallest so the current flowing through is the largest. The magnitude of the first voltage $V_1$ corresponding to the first sequence (first cycle) of the pulse signal can be acquired.

When the (first time) power-on is finished, the first resistance $R_1$ is turned off and the impedance of the compensation unit 20 is decreased (i.e., the impedance compensation of the compensation unit 20 is performed) so that the equivalent resistance values after the parallel connection will be the same and the current flowing through may be the same. When the power is turned on again, the magnitude of the second voltage $V_2$ corresponding to the second sequence (second cycle) of the pulse signal can be acquired.

Similarly, when the (second time) power-on is finished, the first resistance $R_1$ and the second resistance $R_2$ are turned off and the impedance of the compensation unit 20 is further decreased so that the equivalent resistance values after the parallel connection will be the same. In other words, when both the first resistance $R_1$ and the second resistance $R_2$ are turned off, the impedance of the compensation unit 20 is smaller than the impedance when only the first resistance $R_1$ is turned off so that the current flowing through may be the same. When the power is turned on again, the magnitude of the second voltage $V_3$ corresponding to the third sequence (third cycle) of the pulse signal can be acquired. Accordingly, the sequence signal may be used as the basis of the sequence, and the impedance of the compensation unit 20 is adjusted (decreased) to maintain the same current so that the voltage difference between any two LED modules is maintained constant, thereby increasing the accuracy of identifying the detected voltage.

Figure 7B:
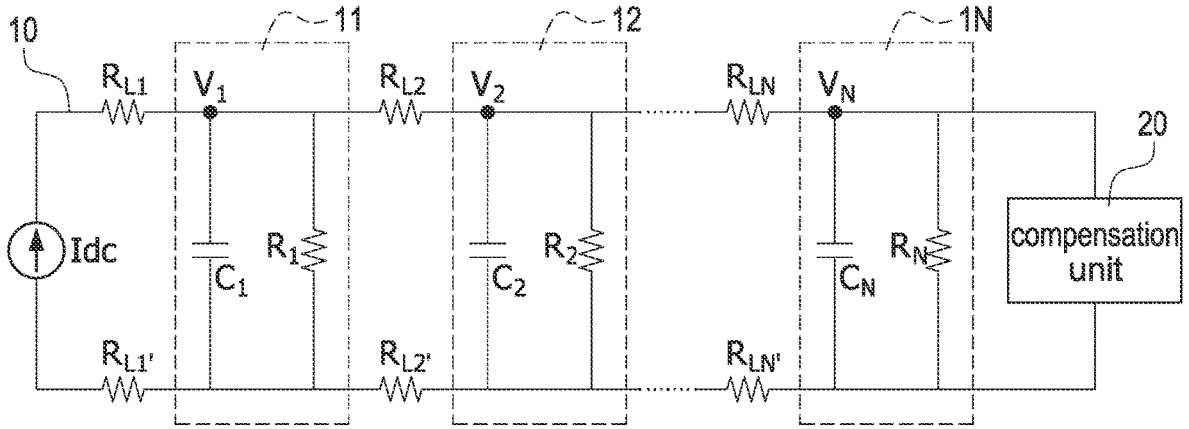
FIG. 7B is a circuit diagram of the parallel sequenced LED light string supplied power by the constant-current source according to the second embodiment of the present disclosure.

In comparison with the constant-voltage power supply shown in FIG. 7A, the impedance compensation of the constant-current power supply shown in FIG. 7B is to increase the impedance of the compensation unit 20 so that the equivalent resistance values after the parallel connection will increase and the current flowing through is decreased. Accordingly, the sequence signal may be used as the basis of the sequence, and the impedance of the compensation unit 20 is adjusted (increased) to maintain the same current so that the voltage difference between any two LED modules is maintained constant, thereby increasing the accuracy of identifying the detected voltage.

Figure 8:
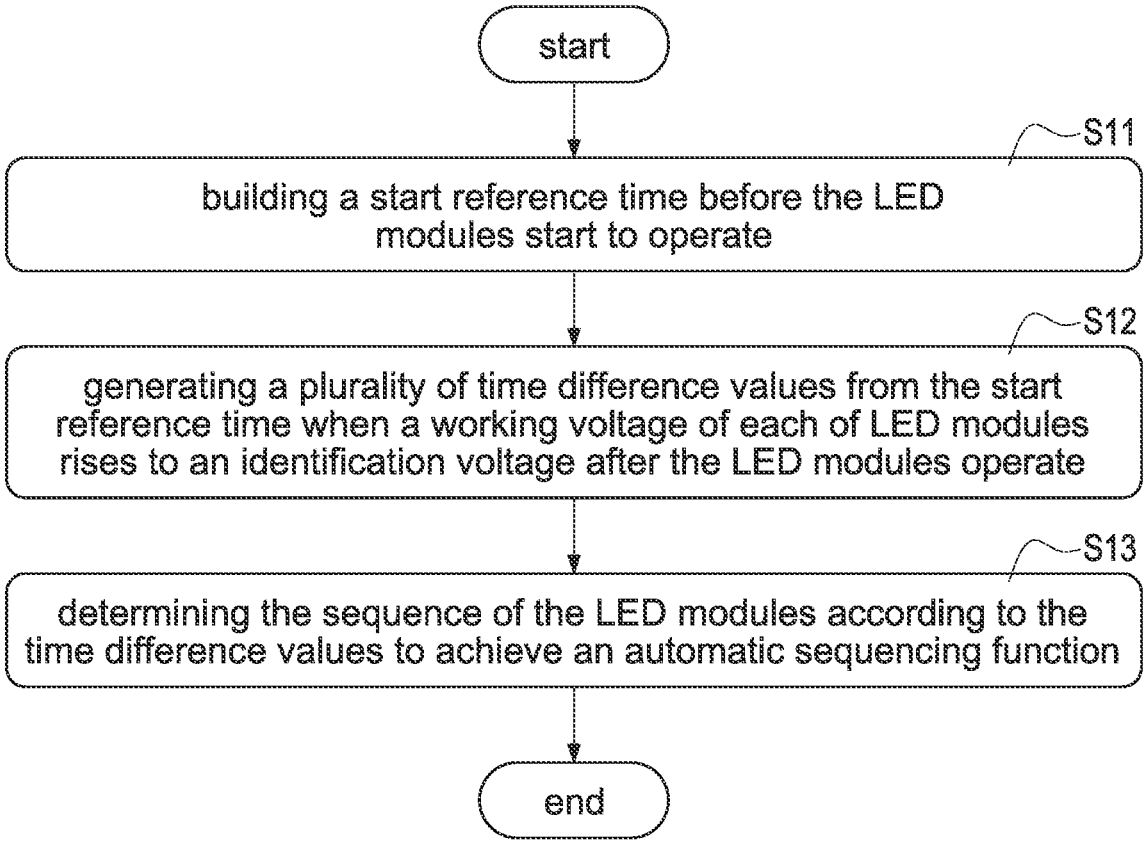
FIG. 8 is a flowchart of a method of automatically sequencing an LED light string according to the present disclosure.

Please refer to FIG. 8, which shows a flowchart of a method of automatically sequencing an LED light string according to the present disclosure, and also refer to FIG. 5. The method includes the following steps of: building a start reference time before the LED modules start to operate (S11). Afterward, generating a plurality of time difference values from the start reference time when a working voltage of each of the LED modules rises to an identification voltage after the LED modules operate (S12). Finally, determining the sequence of the LED modules according to the time difference values to achieve an automatic sequencing function (S13).

Incidentally, the method of automatically sequencing the LED light string provided by the present disclosure may correspond to the operation of the above-mentioned LED light string with the automatic sequencing function. Therefore, the detail description of the method of automatically sequencing the LED light string is omitted here for conciseness.

Accordingly, the LED light string with automatic sequencing function and the method of automatically sequencing the same are provided to determine the sequence of the LED modules by using the built-in lookup table to acquire the relationship between the time difference values and the sequence of the LED modules, thereby simplifying the circuit design and quickly complete the sequence of the LED light string.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. An LED light string with automatic sequencing function, comprising:

a circuit switch, a plurality of LED modules, electrically connected to the circuit switch, each LED module comprising:

an identification circuit, connected to a drive voltage source, and a control unit, configured to generate a control signal to turn on and turn off the circuit switch, wherein before the LED modules start to operate, the control unit turns off the circuit switch so that a working voltage of each LED module is less than an identification voltage and the identification circuit builds a start reference time, wherein the control unit turns on the circuit switch so that the working voltage increases to the identification voltage and the identification circuit generates a plurality of time difference values from the start reference time, wherein the LED modules determine the sequence of the LED modules according to the time difference values to achieve an automatic sequencing function.

2. The LED light string as claimed in claim 1, wherein the time difference values are compared with a plurality of time difference ranges to determine the sequence of the LED modules.

3. The LED light string as claimed in claim 2, wherein the time difference ranges are built in a lookup table.

4. The LED light string as claimed in claim 1, wherein the identification circuit comprises:

a plurality of diodes connected in series, a switch, connected to the diodes in series to form a series-connected path, a resistor, a first end of the resistor connected to a first end of the series-connected path, and a switching switch, connected to a second end of the series-connected path and a second end of the resistor, and configured to switch the operation of the dioses and the switch of the series-connected path, or the operation of the resistor.

5. The LED light string as claimed in claim 1, wherein the identification circuit comprises:

a plurality of p-type MOSFET switches connected in series to form a series-connected path, a p-type MOSFET switch, a first end of the p-type MOSFET switch connected to a first end of the series-connected path, and a switching switch, connected to a second end of the series-connected path and a second end of the p-type MOSFET switch, and configured to switch the operation of the p-type MOSFET switches of the series-connected path, or the operation of the p-type MOSFET switch.

6. The LED light string as claimed in claim 1, wherein the identification circuit comprises:

a plurality of n-type MOSFET switches connected in series to form a series-connected path, a n-type MOSFET switch, a first end of the n-type MOSFET switch connected to a first end of the series-connected path, and a switching switch, connected to a second end of the series-connected path and a second end of the n-type MOSFET switch, and configured to switch the operation of the n-type MOSFET switches of the series-connected path, or the operation of the n-type MOSFET switch.

7. The LED light string as claimed in claim 1, wherein the LED modules are connected in series to form the LED light string.

8. The LED light string as claimed in claim 1, wherein the LED modules are connected in series and in parallel to form the LED light string.

9. The LED light string as claimed in claim 1, wherein the LED modules are connected in parallel and in series to form the LED light string.

10. A method of automatically sequencing an LED light string, the LED light string comprising a plurality of LED modules, the method comprising steps of:

(a) building a start reference time before the LED modules start to operate, (b) generating a plurality of time difference values from the start reference time when a working voltage of each of the LED modules rises to an identification voltage after the LED modules operate, (c) determining the sequence of the LED modules according to the time difference values to achieve an automatic sequencing function.

11. The method as claimed in claim 10, wherein the step (a) further comprises a step of:

turning off a circuit switch electrically connected to the LED modules so that the working voltage of each of the LED modules is less than the identification voltage to building the start reference time.

12. The method as claimed in claim 11, wherein the step (b) further comprises a step of:

turning on the circuit switch so that the working voltage rises to the identification voltage.

13. The method as claimed in claim 10, wherein the time difference values are compared with a plurality of time difference ranges to determine the sequence of the LED modules.

14. The method as claimed in claim 13, wherein the time difference ranges are built in a lookup table.

* * * * *